US010493368B2

(12) United States Patent
Beumers et al.

(10) Patent No.: US 10,493,368 B2
(45) Date of Patent: Dec. 3, 2019

(54) AMUSEMENT PARK RIDE

(71) Applicant: LAGOTRONICS PROJECTS B.V., Venlo (NL)

(72) Inventors: Mark Thomas Gertruda Beumers, Venlo (NL); Jacobus Josephus Adrianus Groen In 'T Wout, Venlo (NL)

(73) Assignee: LAGOTRONICS PROJECTS B.V., Venlo (NL)

( * ) Notice: Subject to any disclaimer, the term of this patent is extended or adjusted under 35 U.S.C. 154(b) by 0 days.

(21) Appl. No.: 15/779,399

(22) PCT Filed: Nov. 28, 2016

(86) PCT No.: PCT/NL2016/050836
§ 371 (c)(1),
(2) Date: May 25, 2018

(87) PCT Pub. No.: WO2017/091076
PCT Pub. Date: Jun. 1, 2017

(65) Prior Publication Data

US 2018/0311588 A1 Nov. 1, 2018

(30) Foreign Application Priority Data

Nov. 27, 2015 (NL) ..... 2015864

(51) Int. Cl.
*A63G 31/16* (2006.01)
*A63G 1/10* (2006.01)
*A63G 5/00* (2006.01)

(52) U.S. Cl.
CPC ..... *A63G 31/16* (2013.01); *A63G 1/10* (2013.01); *A63G 5/00* (2013.01)

(58) Field of Classification Search
CPC . A63G 1/00; A63G 1/38; A63G 31/00; A63G 31/02; A63G 31/16; A63B 67/00
(Continued)

(56) References Cited

U.S. PATENT DOCUMENTS 3,873,085 A 3/1975 Nakamura
5,499,920 A 3/1996 Trumbull
(Continued)

FOREIGN PATENT DOCUMENTS

CN 204767337 U 11/2015
GB 2 249 729 A 5/1992
KR 2001 0083829 A 9/2001

OTHER PUBLICATIONS

International Search Report for International Application No. PCT/NL2016/050836 dated May 11, 2017.
(Continued)

*Primary Examiner* — Kien T Nguyen
(74) *Attorney, Agent, or Firm* — Shumaker, Loop & Kendrick, LLP; Patrick B. Home

(57) ABSTRACT

The present invention relates to a ride system that can include static and/or interactive elements and is arranged for high passenger throughput with additional dimensions. To this end, an amusement ride is provided for amusement of groups of visitors of an amusement park or the like, the amusement ride including a platform, divided into multiple segments. The segments are arranged to facilitate the groups of visitors mutually shielded from each other; and interactive objects, divided circumferentially around the platform are provided, for interaction of the groups of visitors with the interactive objects. The segments of the platform include electronic input devices for electronic interaction of the group with the interactive objects by control of the input devices, and the segments being polygon segments of the platform, and wherein at least one of the platform and the
(Continued)

interactive objects are arranged for relative rotation with respect to each other around a center of the platform for relative movement between the segments with the groups and the interactive objects.

14 Claims, 3 Drawing Sheets

(58) Field of Classification Search
USPC ..... 472/43, 59–61, 130; 434/29, 55
See application file for complete search history.

(56) References Cited

U.S. PATENT DOCUMENTS

| | | | | |
|---|---|---|---|---|
| 5,716,281 | A * | 2/1998 | Dote | F41J 9/14 463/2 |
| 5,785,592 | A * | 7/1998 | Jacobsen | A63F 9/0291 273/349 |
| 6,220,965 | B1 * | 4/2001 | Hanna | A63G 7/00 463/52 |
| 6,796,908 | B2 * | 9/2004 | Weston | A63G 7/00 434/55 |
| 2015/0190726 | A1 | 7/2015 | Frolov | |

OTHER PUBLICATIONS

May 13, 2019 Office Action issued in European Application No. 16813151.4 (5 pages).
Anonymous; "Casino Royale;" Exhibitor magazine; Oct. 26, 2015; URL: https://www.exhibitoronline.com/topics/article.asp?ID=1703 (6 pages).

* cited by examiner

AMUSEMENT PARK RIDE

TECHNICAL FIELD

The present invention generally relates to an amusement park ride, arranged for high throughput of the passengers and high daily capacities. More in particular, the present invention relates to a ride system that can comprise static and/or interactive elements and is arranged for high passenger throughput with additional dimensions.

BACKGROUND OF THE INVENTION

Amusement rides or attractions are present in multiple forms in for example amusement parks or other locations where visitors are entertained by such rides or attractions. Some of the more conventional amusement rides are of a passive type wherein the visitors, often in groups, are moved through the ride along a ride path and entertained for example by the speed of the ride. Roller-coasters are perhaps the most well known of such types of rides.

Most visitors are yet very familiar with roller-coasters, in all sorts of forms. To increase the level of amusement, amusement parks seek for additional dimensions to add to conventional existing rides to attract visitors with increased levels of entertainment or to develop and deploy novel attractions having multiple dimensions of entertainment.

A way to increase the level of entertainment and to add an additional dimension is to enable the ride to provide interaction with the visitors. With interaction, the visitors can be impressed and excited.

Interactive rides consist of a scene wherein for example a certain game is simulated, such as a shooter game. In the scene the visitors of the park can interact, in groups or alone, with elements of the scene, for example by a shooter device present in the scene which can be used to shoot towards targets present in the scene in the form of a physical object, or a virtual object shown on a large display. Multiple visitors can be challenged in a game setting to compete against each other, or against a computer controlled competitor.

The scene is often equipped with additional audio and or video systems, which are for example arranged to provide audio or visual effects upon hitting a target in the scene by one of the visitors.

Since the scene of such an interactive ride is often either very large, or not able to cope with large groups of visitors, the capacity of such rides is non-optimal. With an increasing demand for such next level amusement rides, the amusement parks are faced with the difficult challenge to handle all visitors that want to experience the interactive ride.

Accordingly, it is an object of the present invention to provide an amusement ride with improved visitor capacity.

It is a further object of the present invention to provide an interactive amusement ride with added dimension for increased visitor experience satisfaction.

It is a yet further object of the present invention to provide an interactive amusement ride with improved visitor capacity and/or limited ground space requirement.

SUMMARY

In a first aspect, there is provided an amusement ride for amusement of groups of visitors of an amusement park or the like, said amusement ride comprising:

a platform, divided into multiple segments, said segments being arranged to facilitate said groups of visitors mutually shielded from each other; and interactive objects, divided circumferentially around said platform, for interaction of said groups of visitors with said interactive objects; wherein said segments of said platform comprise electronic input devices for electronic interaction of said group with said interactive objects by control of said input devices, and said segments being polygon segments of said platform, and wherein at least one of said platform and said interactive objects are arranged for relative rotation with respect to each other around a center of said platform for relative movement between said segments with said groups and said interactive objects.

Several amusement rides are known in the art. Amusement parks or theme parks often offer a variety of amusement rides for their visitors. Some of these known amusement rides, like rollercoasters, transport groups of visitors of the park in a carriage over an outside track designed to give the visitors a thrill by the speed and course of the carriage over the track.

Other known amusement rides are dark rides, which can be considered the indoor alternative for outside amusement rides such as rollercoasters. In a dark ride groups of visitors travel through the ride, often from one scene to another, and so on until the end location of the ride. In some dark rides, often those having a closed loop track, the location to enter the ride is the same location as where the ride ends. In other, often non-closed loop tracks, the location to enter and exit the ride often differ from each other. On the track of a dark ride, closed loop or non-closed loop, guided vehicles, cars or carriages, travel through the ride over track following a certain ride path or route. Although referred to as track, this is also to be interpreted as contactless track, for example by magnetic movement, or by movement via a wire or the like. The skilled person will appreciate which alternatives apply.

Nowadays modern novel amusement rides are often interactive. In such interactive environment, the visitors interact in a game or game like setting with objects located within a certain scene representing for example a shooter game.

Such known interactive amusement rides or interactive amusement attractions are arranged for one, two or several visitors to perform the game within the scene by interaction with the interactive objects within the scene. The base of the ride is stationary, although (some of) the interactive objects can be arranged to move (upon interaction with the visitors) within the scene, for example when hit by a shooter in a shooter game scene.

Since these interactive amusement rides are very popular under amusement park visitors, and such interactive rides can only handle a few amount of visitors at a time, a large amount of rides have to be present at an amusement park to cope with such visitor attendance. Since ground space is limited, especially when used as a dark ride inside a building, there is a need for improving capacity of such interactive rides without requiring high amounts of ground space.

The invention is based on the insight that in order to provide increased visitor capacity at limited ground space, the scene in which the visitors perform the game or interact with the interactive object, has to be moved throughout the ride such that several groups of visitors can attend simultaneously or wherein at least the visitor capacity is increased by virtual movement of the visitors and/or the interactive objects in the scene.

Accordingly, the amusement ride according to a first aspect of the invention is arranged for several groups of visitors that simultaneously attend the ride, in a sequential manner.

Within the context of the invention, a group of visitors is not only to be understood as several visitors, but also one single visitor, two visitors, or any predetermined amount of visitors.

Solutions known in the art are directed either to simultaneous or sequential attendance, i.e. either a large group of visitors (corresponding to the full visitor capacity of the ride) enter and exit the ride simultaneously, or the group is divided into sub groups or even individuals which enter and exit the ride in a sequential manner and thus divided over time or in a staggered manner.

In the first example of the simultaneous attendance, all visitors undergo the same (virtual) experience/ride or play the same game. This has several drawbacks, e.g. entrance and exit is inefficient and takes a lot of time due to the large amount of visitors and the inefficient handling of large groups, and the setup of such a scene with interactive elements wherein a lot of visitors simultaneously interact with these elements is cumbersome and requires large capacity of processing power and presentation devices (e.g. displays) and input devices which are suitable for simultaneous usage with such a number of visitors.

In the second example of the sequential attendance the visitors are divided either in groups or in individuals and are moved along a path such that the movement and flow is regulated. In order to increase capacity of the ride it is thus known to increase the length of the path since the length of the path through the ride defines how many visitors or people may be present in the ride at the same time. Increasing path length has the drawback that it is difficult to let the visitors undergo one single interactive experience/ride or game during the length of the path, hence, known rides have several individual scenes in which several individual experiences/rides or games are provided. Moreover, such sequential rides have the drawback that increasing capacity by increasing path length also increases the size of the ride e.g. the costly footprint of the ride in an amusement park.

The present invention provides a solution to these problems known in the art by dividing the visitors in groups for sequential attendance wherein each group is moved (or only virtually moved since the group members are given the impression of movement) throughout the ride and inefficiency of large simultaneous entrance/exit is avoided, control and processing of all electric components may be performed in clusters and increasing the capacity does not require increasing a path length and thus increase the rides footprint in a ratio corresponding to the capacity increase.

The present invention provides such a solution by either moving (rotation) the groups along the interactive objects by rotating a platform on which the groups take place, or by moving the interactive objects around the platform with the groups, by moving them both and with respect to each other, or by moving a wall surface that is positioned circumferentially around the platform and the interactive objects, hence by only giving a virtual impression of movement.

In a preferred example at least the platform is arranged for rotation such that the groups members or visitors are rotated along the interactive objects. The group (members) enters the ride at a certain enter/start or loading location. From that location the ride starts and the group members can take place at a segment of a platform, for example on a bench or chairs located there. Each group takes place at a segment of the platform of the ride. The platform to this end is divided into several segments, for example, 4, 5, 6, 7 or even more segments.

The platform is preferably regular polygon shaped and divided into segments but could also be circular shaped. The segments are thus polygon segments of the platform or circle segments of the platform. The platform rotates around its center position such that the segments move radial and the group members in the segment are moved along interactive objects located at the circumference of the polygon shaped platform.

The polygon shaped platform can be a circle or a regular polygon shaped with 1 to n sides, such as a regular pentagon (5 sides), a regular hexagon (6 sides), regular heptagon (7 sides), etc.

Along the circumference of the platform multiple objects are located that form one single scene or multiple scenes such that the movement of the segment with the group provides a ride through the amusement ride along a ride path through multiple scenes, or along one large scene. In the example of the multiple scenes, these scenes are preferably mutually separated and as such provide distinct scenes.

The objects around the platform, forming part of the scene can be passive decorative elements, or active objects such as interactive (electronic) objects that interact upon actions of the group or members thereof, for example through interaction with the input device on the platform.

The platform thus preferably rotates and preferably one location along the circumference of the platform is, as explained, configured for the group to start the ride by entering a segment. The segment, as being part of the rotating platform, rotates around a center of the platform at a certain speed. During rotation the group can interact with the interactive objects and thus perform the game or experience the interactivity of the ride. When the platform has rotated 360 degrees, the segment is again positioned at the start of the ride, i.e. the start/load location, where the group can leave the ride by exiting the segment such that a next group can enter.

In an example the platform slowly but continuously moves (i.e. rotates) with respect to the interactive objects, thus either the platform moves, or the objects move, or both move in the same direction, in opposite directions, at the same speed (angular velocity) or at different speed.

In yet another example, the platform will move in a discrete manner, e.g. wherein the platform moves for example 30 degrees towards a first scene with interactive objects, stops for a predetermined period of time and then rotates another 30 degrees towards the second scene, and so on until the segment is adjacent the exit and/or entrance.

In an example the platform can be very large, having a high amount of segments. In such an example the loading and unloading locations, i.e. start and stop location, can be located elsewhere, for example at opposite sides. The ride path is then defined by half a circular rotation of the platform instead of a full circular rotation.

By providing several segments, several groups can attend the ride simultaneous, and due to the design of the regular polygon shaped platform and the segments designed thereon the effective ground space of such an interactive ride is limited as compared to conventional (dark) rides wherein a car, carriage of other vehicle travels through the ride over a single (open or closed-loop) track.

In an example, the interactive objects are arranged in scenes, and the amount of scenes corresponds to an amount of segments on the platform.

As indicated, throughout the movement (rotation) of the segment from the load to the unload location, the group members are entertained/amused through interaction with the objects within the scene or the several scenes. These objects can be passive décor elements, active elements that, for example, react at regular intervals or in an interactive manner in response to a certain action of one or more of the group members. Hence, for example physical elements that comprise electronic components which can interact with the group members through the input devices provided on the platform. For example these elements are décor elements having audio and/or visual presentation means such as audio speakers and/or light units which produce audio and/or visual signals when interactions is to be performed (that element becomes a target) or when interaction has taken place (when the element is hit). The scene can furthermore comprise digital systems such as one or more large display (s), audio systems, video cameras and microphones. Preferably, each scene comprises at least one large display on which content is shown in accordance with the theme of the ride and preferably in accordance with the specific scene. Such content can for example be targets of a shooter game.

In an example, the interactive objects comprise a large screen, the large screen in particular being a large display or a screen arranged for projecting video content thereupon by a video projector.

In an example, the large screen is arranged for display of three-dimensional video content.

Preferably the interactive objects comprise a large screen such as a large LCD display or the like. This could be a 360 (or less) degrees projector which is arranged to project images (and video content) circumferentially around the platform.

Virtual objects and video images can be shown on the display. As an alternative, the large screen can also be a screen on which a projector projects the virtual objects or video images. The projector can also be a dual projector arranged for stereoscopic three-dimensional representation of the objects or digital content. This adds an extra dimension to the interactive ride. The projector can be arranged on the platform, such that the projection generated by the projector rotates in correspondence with the rotation of the platform, or the projectors can be stationary such that the platform rotates with respect to the projection. In the first example the platform is moved and the interactive elements shown on the projection move along with the movement of the platform and in the second example the platform moves past the interactive elements shown on the projection provided by a single multi-degree projector or by plural conventional projectors.

In an example, at least one of the scenes is arranged for the groups to enter in the ride and wherein at least one of the scenes is arranged for the group to exit the ride, and wherein preferably the exit and enter scene are the same.

As indicated, the load and unload locations can be the same, in the case of a platform having a limited amount of segments. For example, the platform can have 7 segments, and the circumference of the platform is divided into 6 scenes that correspond in dimension to the side of the segment. The remaining side of the circumference of the platform is then arranged for loading/unloading of the groups. Alternatively, in the event of a high amount of segments the loading and unloading locations can be at opposite positions of the platform. For example, when the platform is divided into 16 segments, the circumference of the platform is arranged into 14 scenes and 2 sides opposite each other forming the load and unloading positions.

In an example, the segments comprise a motion base for movement of the group upon interaction with the interactive objects.

To further increase interactivity with the group (members), each segment can be provided with a motion base, also known as a motion platform wherein effects are created of the segment or parts thereof such as the seats, or benches, moving in respect of the platform. The movement preferable corresponds to actions initiated by the group members such that the motion base adds an additional level of interaction. The motion base is to be interpreted in its broadest sense, thus all sorts of motion elements can be added per segment. Every segment can contain the same/equal amount and type of motion elements or they can differ.

Other examples of such motion element are pendulum ride like motion elements where group members can take place on a bench or seats and the bench or seats are moved like a pendulum. Other examples of adding a motion element are tower like elements wherein the seats or bench are/is raised and lowered. The speed thereof can differ and could for example also have a drop element such as a drop tower amusement ride. Yet another example is to add additional rotation, for example by having arms or hubs to which the benches or seats are attached. The platform then rotates a in a certain direction and the hubs or arms rotate in opposite direction. These arms can be raised, which raises the benches or seats or can even be tilted for example. As such, the platform with its segments and benches or seats operates similarly to an octopus amusement ride, or a calypso ride, or a breakdance ride. Alternatively, each segment can also comprise yet a further rotating platform. Hence, having one large platform, having thereupon multiple smaller platforms, one per segment. These smaller platforms can rotate at the same or different angular velocities and in the same or opposing directions. Each smaller platform is preferably disk shaped, round or at least regular polygon shaped and arranged to accommodate a certain amount of visitors, i.e. group members, for example disposed in two rows, in opposite orientations. Preferably in such a configuration the center of the large platform contains one or multiple displays directed to the smaller platforms/disks and multiple displays at the circumference of the large platform. Thereby the capacity is further increased.

In an example, the segments comprise a motion capture device for interaction of the group with the interactive objects by movement of the group, members of the group, or body parts of the members of the group.

In an example, the segments comprise input devices for interaction of the group with the interactive objects by control of the input devices.

There are several manners in which the group members can interact with the interactive objects, physical objects or virtual objects shown on the one or more large displays. This can for example be done by dedicated controls, e.g. human interface devices such as pointing devices arranged to aim at the interactive objects. Examples thereof are pointing devices in the form of shooters that are arranged to determine if the shooter is correctly aimed at a target upon pushing a trigger button or the like. Other examples are touchscreen devices that can be used as input device. Yet another example is the employment of motion detection devices wherein the position, orientation and movement of the group members and/or their body parts can be determined and used as input to interact with the interactive objects. For example to move virtual objects such on the large screen.

The interactive objects, as indicated for example in the form of virtual objects displayed on a large display, or in combination with physical (interactive) objects, can be disposed on the rotating platform, or adjacent to the platform in the circumference thereof, or both. Preferably, in case of large displays as interactive objects, the large displays are disposed adjacent to the platform in the circumference thereof. Then preferably multiple displays are disposed, the amount being equal to the amount of segments, minus one (or two), being the location(s) where the group can enter and/or exit the ride. However, the large displays can also be disposed on the rotating platform itself, e.g. one or more per segment.

In an example, the amusement ride further comprises a server arranged for determining interaction input of the group and control of the interactive objects in accordance with the determined interaction input, wherein the interaction input preferably is determined through a human input device and/or a motion capture device.

In an example, the platform is regular polygon shaped.

The platform could be circular shaped, but is preferably polygon shaped and more preferably polygon shaped having a number of sides corresponding with the number of segments and the number of scenes.

In an example, the platform is arranged for rotating around the center of the platform and wherein the interactive objects are stationary.

In an example, the platform is stationary and the interactive objects are arranged for rotating around the center of the platform.

In an example, both the platform and the interactive objects are arranged for rotating around the center of the platform.

In an example at least three different parts can be distinguished in the amusement ride, the first part being the platform for supporting and dividing the groups of visitors, the second part being the interactive elements divided circumferentially around the platform and provided in the form of physical objects which are arranged for digital interaction with the visitors and/or display means such as a digital projection of images/videos for digital interaction with the visitors and finally the third part a wall surface arranged circumferentially around the platform. Preferably the wall surface is arranged for projection thereon by the projector(s) and hence displaying the digital interactive elements.

These three parts are positioned circumferentially or radially around each other and from these three parts at least one is arranged to rotate with respect to the other parts. For example, the wall can be stationary and be provided with an entrance/exit and the platform may be arranged to rotate the groups with respect to the stationary wall surface such that upon entrance, the group is rotated for 360 degrees and can exit at the same exit location. Alternatively, the platform could be stationary and the wall surface, preferably provided with with an entrance/exit, rotates with respect to the platform. Hence, in such a configuration the entrance/exit position moves and groups can enter/exit when the entrance/exit in the wall is positioned adjacent their segment on the platform. As yet another alternative, the platform and the wall surface can be stationary an only the interactive elements are arranged to rotate around the platform. Thus in such an embodiment, movement is simulated (virtual movement) as the group members are given only the impression of movement by movement of the elements along the platform. In such an embodiment, each wall surface and/or platform is arranged for entrance and exit of the group members.

In a further aspect of the invention an amusement ride for amusement of groups of visitors of an amusement park or the like, the amusement ride comprising:

a platform, divided into multiple segments, the segments being arranged to facilitate the groups of visitors mutually shielded from each other; and interactive objects, divided circumferentially around the platform, for interaction of the groups of visitors with the interactive objects; wherein the segments of the platform comprise electronic input devices for electronic interaction of the group with the interactive objects by control of the input devices, and the segments being polygon segments of the platform, a wall surface, provided circumferentially around the platform and the interactive objects and arranged to facilitate the groups of visitors for entering and exiting the segment of the amusement ride.

In an example at least one of the platform, the interactive objects and the wall surface are arranged for rotation around a center of the platform.

The invention will now be described in more detail by means of specific embodiments, with reference to the enclosed drawings, wherein equal or like parts and/or components are designated by the same reference numerals. The invention is in no manner whatsoever limited to the embodiments disclosed.

DETAILED DESCRIPTION

Figure 1A:
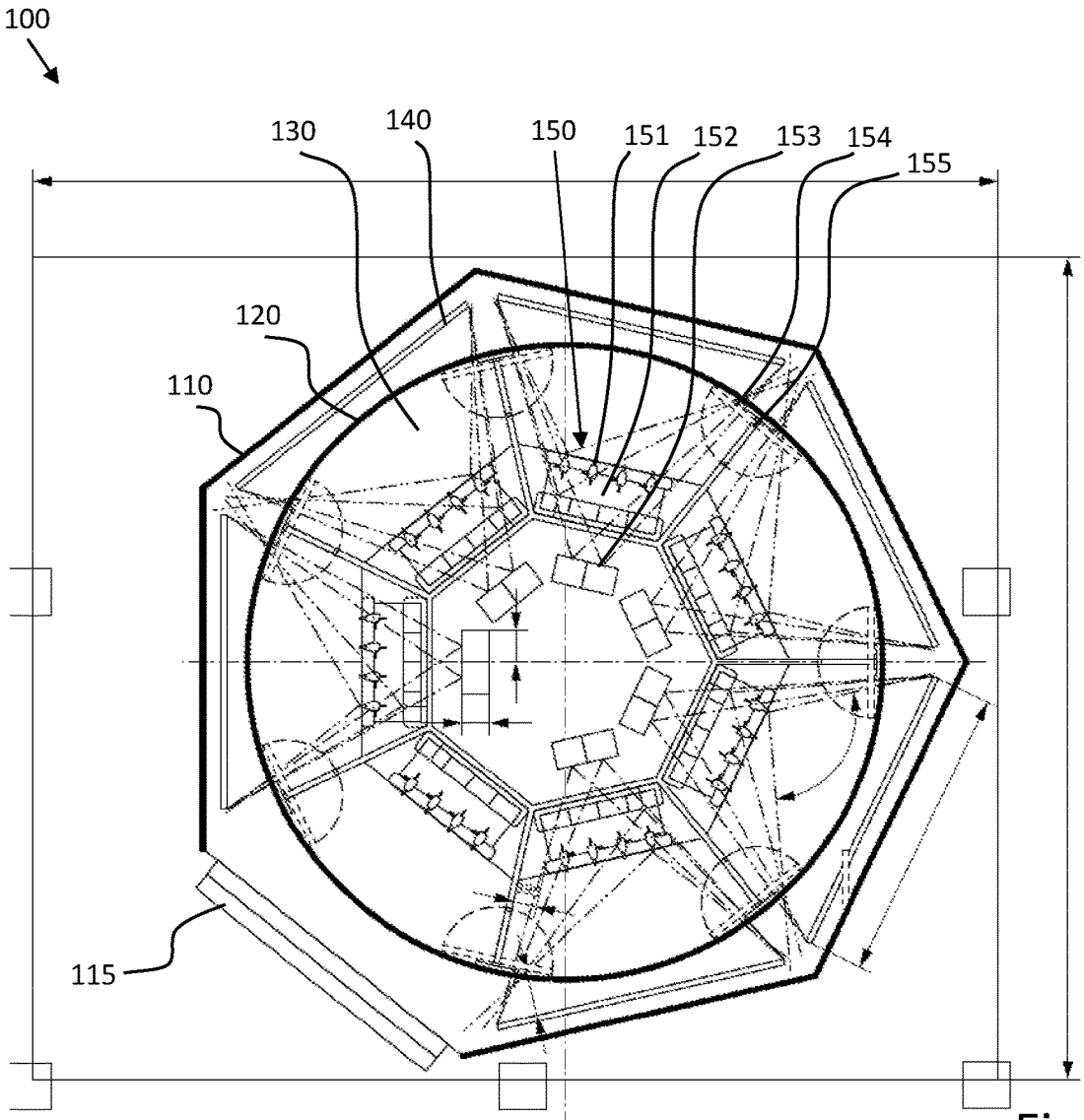
FIGS. 1*a* and 1*b* show top and front views of an amusement ride according to an aspect of the invention.

In FIGS. 1*a* and *b*, in top view and side view, show an example of an amusement ride 100 for amusement of groups of visitors of an amusement park or the like. The amusement ride 100 consists of a platform 120, which is divided into multiple segments 130. The segments 130 are arranged to accommodate/facilitate the groups of visitors. The segments 130 are preferably divided such that the groups are shielded from each other by a segment separating panel 155.

Around the rotating platform 120 one or more scenes 110 are created and positioned circumferential around the rotating platform 120. The scenes consist of passive (decorative) elements to create a certain feel and ambience. The scene further consists of interactive objects such as large screens 140. The interactive objects are arranged to interact with the group members within the segment that are positioned at the scene 110 where the large screens 140 are positioned.

The platform 120 is regular polygon shaped, which means round, square, regular pentagon, regular hexagon, regular heptagon, regular octagon, regular enneagon, etc. depending on the segments. The platform rotates in relation to the interactive objects. Alternatively, the interactive objects 140 can also be arranged to rotate around the static platform 120, or in yet another alternative, both the interactive objects 140 can rotate as well as the platform 120, in opposite direction thereof.

The speed at which the rotating platform spins, i.e. the angular velocity, could in an example be related to the interactive skills of the group members. Thus, if the group members are so skilled that they achieve a high hit rate in for example a shooter game, the speed of rotation of the platform can be lowered or increased accordingly. As such, an additional interactive dimension is added to the ride.

The ride is preferably provided with means for detecting the position of the rotating element, e.g. a detector to detect the (angular) position of the platform and/or the rotating wall. The position is preferably communicated to the server such that the interactive elements can be controlled in a corresponding manner, e.g. when the segment is positioned adjacent the wall surface of the interactive elements/display 140. Upon discrete movement of the wall or platform the detection can take place by position sensors in the form of switches or electrical contacts that are short circuited when the platform moves from one position to the other. Other examples are also suitable, and the skilled person will appreciate which other alternatives are applicable.

By letting the platform rotate around the interactive elements (or vice versa), the visitors of the amusement park that want to visit and experience the amusement ride can be divided into groups. Each of the segments 130 of the rotating platform 120 can accommodate one of these groups. An advantage of having several scenes with groups of visitors positioned in segments on a rotating platform is that with such a ride, a relative small ground surface is needed, in which a relative large amount of visitors can be entertained. As such, the capacity of an amusement ride according to the invention is increased. Moreover, the level of entertainment is also further increased, by adding movement of the platform with respect to the scenes and its interactive elements for example.

In the example shown in FIG. 1 the platform 120 is divided into 7 segments 130. In this example the scenes are positioned circumferential around the platform in a regular polygon shape with seven sides, i.e. a regular heptagon. In this example the platform has a round shape. This can also be seven sided regular polygon shaped, i.e. regular heptagon as well.

Figure 1B:
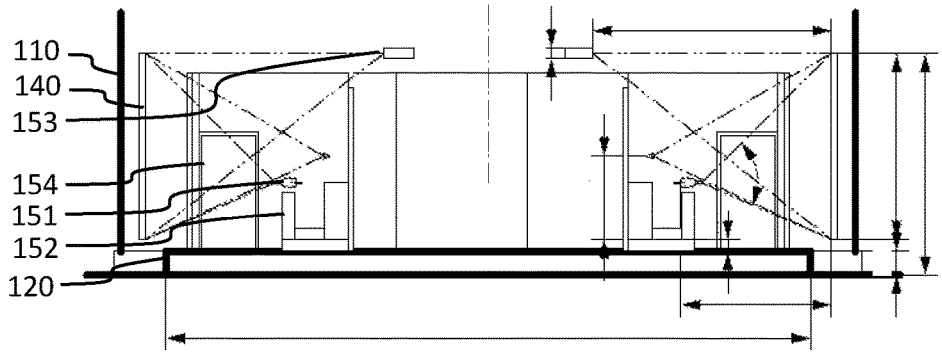
Figure 2:
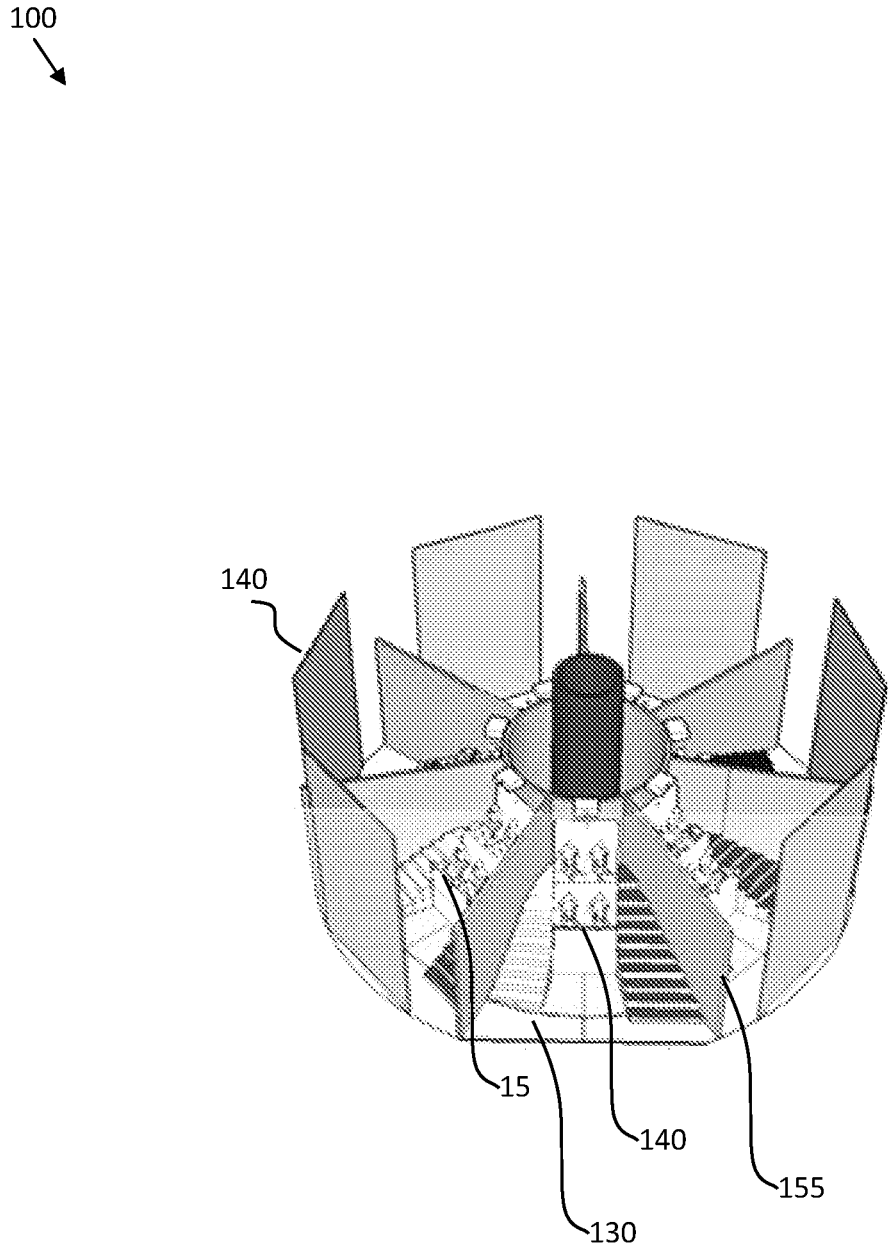
FIG. 2 shows a perspective view of the amusement ride according to an aspect of the invention.

In FIG. 2 the perspective view is shown of the amusement ride 100 according to the example as shown in FIGS. 1*a* and 1*b*. The amusement ride 100 consists of seven segments 130 to accommodate seven groups of visitors. These visitors can take place inside the segment on seats 152 or benches positioned in the segments. The visitors of one group cannot see the visitors of another group that are present in a different segment, since the segments are separated by segment separation panels 155.

In the example shown in the figures, controller devices are present in the segments by which the visitors can interact with the interactive element, in this example shown on the large screen 140. Several types of controller devices can be used, for example, pointing device such as a shooter device, laser pointing device, but also touchscreen device, or a device to detect movement/motion of the visitor, or its limbs, i.e. a gesture detecting device.

The large screen could be a very large active panel such as an LCD or plasma panel, but is preferably a passive screen on which content is shown by a projector/beamer 153. The projector or projectors can be positioned statically or dynamically, hence, on the rotating platform or on a static base. A computer device, e.g. a central server (now shown), controls the panel or the projector. The computer is thus operatively connected to the panel or projector and to the controller devices, e.g. the shooters 151. The computer can also be connected to other active elements in the scene or the segments, such as additional light effect elements to add visual effects, speakers to add audio effects, video cameras to determine response of the visitors or for example to scan facial expression such that it is processed by the server and can be projected as an overlay layer on digital content shown on large screen. Any of the communicative connections between the server and the other components can be employed by wire or wireless connection.

Preferably, the content shown on the large screen has depth perspective. This can be achieved by a single mono projector arranged for 3D projection or, as shown in the figures, by use of two projectors of which one can be used to display content in 2D and the second projector can be added to add depth and create a virtual 3D environment.

The interactive elements of the scene are preferably, as indicated, shown as digital content on the large screen 140. In the example shown in the figures, several scenes 110 can be identified. More in particular, the platform 120 is divided into seven segments 130, and there are six scenes. Hence, the amount of scenes equals the amount of segments, minus one, which is used to load/unload the group. Hence, after the group members enter the amusement ride at that location, the group members take place on the seats 152 or benches in the segment 130. The segment forms part of the platform 120 and thus rotate in respect of the static/stationary scenes with its interactive elements, e.g. large screens 140. As shown in the figures the amount of screens equals the amount of scenes which equals the amount of segments minus one. However, it is also possible to use one single large screen that covers all scenes. As such, the scenes could also be a single scene with one single (or multiple) large screens such that, once the group takes place in the segment, the segment slowly rotates in front of the large screen until the segment returns back to the position where the group entered and thus exits the ride. Alternatively, the enter and exit location can also be different, e.g. opposing positions. This is advantageously when the platform size is very large such that it can be divided into a large amount of segments to accommodate a large amount of groups. The route, or ride path, thought the ride is then 180 degrees of rotation of the rotating platform whereas in the other example, the route through the ride is 360 degrees of rotation of the rotating platform.

In the example demonstrated in FIGS. 1 and 2 the ride is constructed in such a manner that the platform rotates and the wall surfaces and large screens 140 are stationary/fixed. However, these can also be constructed the other way round, wherein the wall surface rotates around a stationary platform, or wherein both the wall surface and the interactive elements rotate around the stationary platform, or wherein several elements move and/or move relatively with respect to each other.

Figure 3:
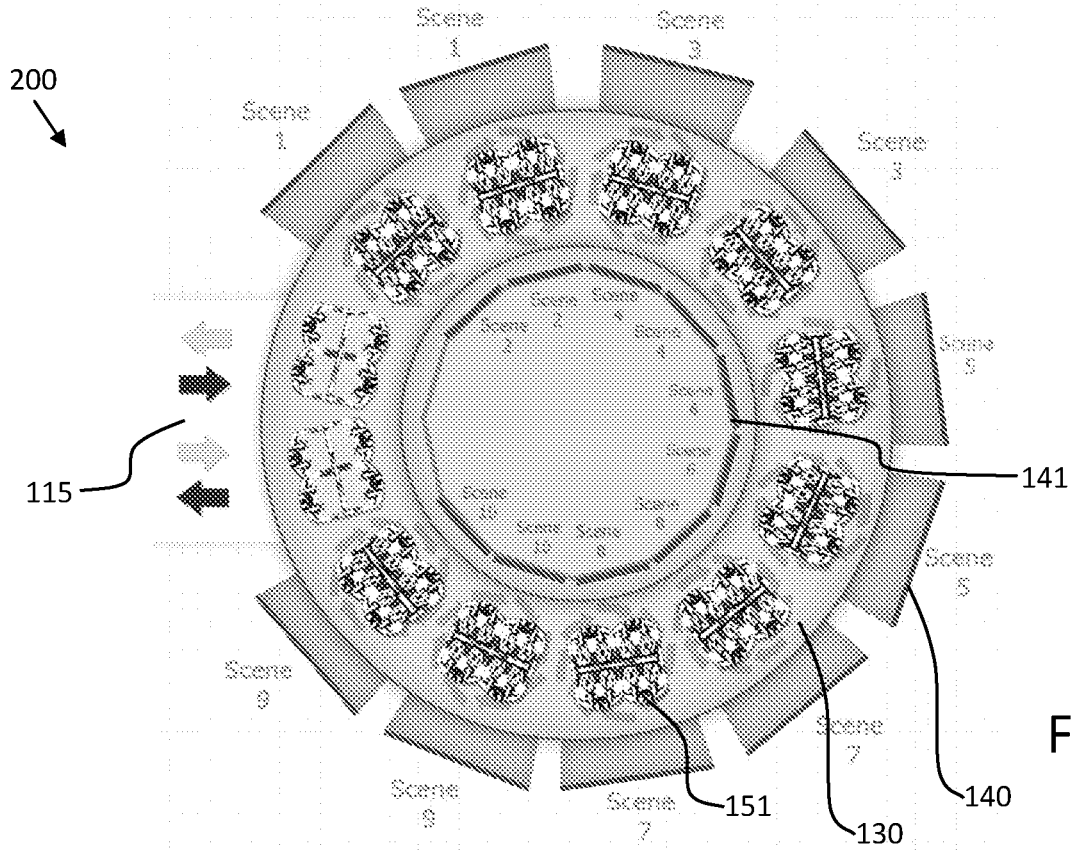
FIG. 3 shows a top view of another example of an amusement ride according to an aspect of the invention.

In FIG. 3 yet another example of an interactive ride 200 according to the invention is shown. This ride consists also of a large rotating platform which is divided into multiple segments, i.e. twelve in this case. The segment also consists of a small rotating platform, which preferably rotates in opposite direction with respect to the large platform. The small rotating platforms are in this example arranged to facilitate group sizes of eight members. These members take place on two benches which are disposed on the small rotating platform in opposing directions such that the group members look away from each other. Each bench has four shooters 151, one for each group member. The shooters can be used to aim at the interactive objects displayed on the large screens 140 that are distributed around the platform and also to aim at the interactive objects displayed on smaller screens 141 that are disposed at the inner part/circle of the platform. Both the small 141 and large 140 screens represent one single scene. At one position in the circumference of the platform, there are no screens disposed. At this location the visitors can enter and exit the ride 151. In this example arranged for two groups to enter and exit at the same time.

Figure 4:
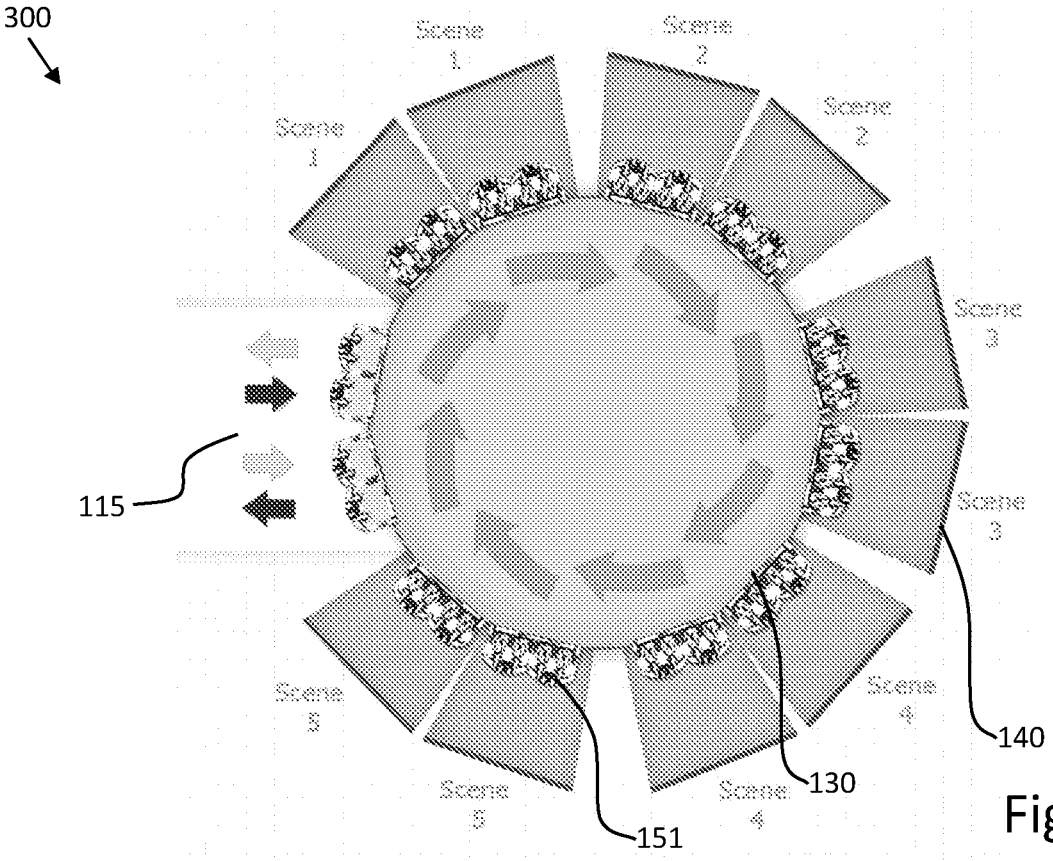
FIG. 4 shows a top view of yet another example of an amusement ride according to an aspect of the invention.

In FIG. 4 yet another example of an interactive ride 300 according to the invention is shown. This ride is build-up around a rotating platform which is divided into several segments 130 but the group members can take place/are facilitated at the circumference of the rotating platform in such a way that the group members are oriented towards the large screens around the platform. In this example the platform rotates in respect of the large screens 140 and the segments 130 do not rotate in respect of the platform. Each segments is arranged to facilitate four group members on a single bench, each bench being equipped with four shooters 151, one for each group member, to interact with the interactive objects displayed on the large screens 140. In accordance with the example of FIG. 3, the example shown in FIG. 4 also has a single enter/exit location 115 where the group can enter and exit the ride, in this particular case, two groups that enter and exit simultaneous.

In the examples demonstrated in the figures, shooting devices 151 are shown to interact with the interactive elements shown on the screens 140. As such the group members are entertained by the amusement ride in a game or game like setting. The content shown on the screens 140 could however also be less or non-interactive, video content.

Based on the above description, a skilled person may provide modifications and additions to the method and arrangements disclosed, which modifications and additions are all comprised by the scope of the appended claims.

The invention claimed is:

1. A dark ride interactive indoor amusement ride for amusement of groups of visitors of an amusement park, said amusement ride comprising:

a platform, arranged to divide said visitors into said group and for facilitating movement of said group of visitors along a path through said dark ride; and interactive objects, divided along said path, for interaction of said groups of visitors with said interactive objects during said movement of said group of visitors along said path, wherein said platform comprise electronic input devices for electronic interaction of said group with said interactive objects by control of said input devices, characterized in that, said platform is divided into multiple segments, said segments being arranged to mutually shield said groups of visitors from each other, said segments being polygon segments of said platform, and wherein at least one of said platform and said interactive objects are arranged for relative rotation with respect to each other around a center of said platform for relative movement between said segments with said groups and said interactive objects.

2. The dark ride interactive indoor amusement ride according to claim 1, wherein said interactive objects are arranged in scenes, and an amount of scenes corresponding to an amount of segments on said platform.

3. The dark ride interactive indoor amusement ride according to claim 2, wherein at least one of said scenes is arranged for said groups to enter in said ride and wherein at least one of said scenes is arranged for said group to exit said ride, and wherein preferably said exit and enter scene are the same.

4. The dark ride interactive indoor amusement ride according to claim 1, wherein said interactive objects comprise a large screen, said large screen in particular being a large display or a screen arranged for projecting video content thereupon by a video projector.

5. The dark ride interactive indoor amusement ride according to claim 4, wherein said large screen is arranged for display of three dimensional video content.

6. The dark ride interactive indoor amusement ride according to claim 1, wherein said segments comprise a motion base for movement of said group upon interaction with said interactive objects.

7. The dark ride interactive indoor amusement ride according to claim 1, wherein said segments comprise a motion capture device for interaction of said group with said interactive objects by movement of said group, members of said group, or body parts of said members of said group.

8. The dark ride interactive indoor amusement ride according to claim 1, comprising a server arranged for determining an interaction input of said group and control of said interactive objects in accordance with said interaction input, wherein said interaction input preferably is determined through a human input device and/or a motion capture device.

9. The dark ride interactive indoor amusement ride according to claim 1, wherein said platform being regular polygon shaped.

10. The dark ride interactive indoor amusement ride according to claim 1, wherein said platform is arranged for rotating around said center of said platform and wherein said interactive objects are stationary.

11. The dark ride interactive indoor amusement ride according to claim 1, wherein said platform is stationary and said interactive objects are arranged for rotating around said center of said platform.

12. The dark ride interactive indoor amusement ride according to claim 1, wherein both said platform and said interactive objects are arranged for rotating around said center of said platform.

13. An amusement ride for amusement of groups of visitors of an amusement park, said amusement ride comprising:

a platform divided into multiple segments, said segments being arranged to facilitate said groups of visitors mutually shielded from each other;

interactive objects, divided circumferentially around said platform, for interaction of said groups of visitors with said interactive objects;

wherein said segments of said platform comprise electronic input devices for electronic interaction of said group with said interactive objects by control of said input devices, and said segments being polygon segments of said platform; and a wall surface, provided circumferentially around said platform and said interactive objects and arranged to facilitate said groups of visitors for entering and exiting said segment of said amusement ride.

14. The amusement ride according to claim 13, wherein at least one of said platform, said interactive objects and said wall surface are arranged for rotation around a center of said platform.

* * * * *